United States Patent [19]

Baird

[11] Patent Number: 4,842,222

[45] Date of Patent: Jun. 27, 1989

[54] KITE LOAD-RELEASING DEVICE

[76] Inventor: Eric A. Baird, 137 Sixth St., Rm. 2, Toronto, Ontario, Canada, M8V 3A6

[21] Appl. No.: 245,520

[22] Filed: Sep. 19, 1988

[51] Int. Cl.[4] ..... A63H 27/08

[52] U.S. Cl. ..... 244/155 R; 244/155 A; 446/34; 446/63; 446/228

[58] Field of Search ..... 244/155 R, 155 A; 446/30, 34, 63, 228, 229

[56] References Cited

U.S. PATENT DOCUMENTS

| | | | |
|---|---|---|---|
| 2,228,697 | 1/1941 | Emmick | 244/155 R |
| 2,279,152 | 4/1942 | Whitehurst | 244/155 |
| 2,446,684 | 8/1948 | Armbrust | 244/155 R |
| 2,464,720 | 3/1949 | Rose | 244/155 |
| 2,469,449 | 5/1949 | Baskin | 244/155 R |
| 2,480,948 | 9/1949 | Moon | 244/155 |
| 3,044,737 | 7/1962 | Vavra | 446/228 |
| 3,088,701 | 5/1963 | Fricke | 244/155 |
| 3,109,257 | 11/1963 | Curtis | 46/86 |
| 3,513,591 | 5/1970 | Hansen | 46/86 |
| 3,961,764 | 6/1976 | Keough | 244/155 R |
| 4,123,021 | 10/1978 | Cruise, Jr. | 244/155 R |
| 4,183,481 | 1/1980 | Elson | 244/155 R |
| 4,194,709 | 3/1980 | Segerson | 244/155 R |
| 4,369,939 | 1/1983 | Elson | 244/155 R |

*Primary Examiner*—Joseph F. Peters, Jr.
*Assistant Examiner*—Gregory R. Poindexter
*Attorney, Agent, or Firm*—Riches, McKenzie & Herbert

[57] ABSTRACT

A load carrying and releasing pendular device for attachment to a kite string and release the load on jerking on the kite string. The device is fixedly attached to the kite string at an upper location. The device is also releasably coupled to the kite string at a second lower location. The kite string is releasable from coupling to the device at the second location by jerking on the string of the kite. The device assumes a first raised position when it is coupled to the kite string both at the first upper location and at the second lower location. On jerking the kite string, the string becomes released at the second lower position and the device pivots from the first raised position to a second lower position. This pivoting of the device, providing movement of portions of the device, relative to the kite string causes the release of the load releasably carried by the device.

10 Claims, 4 Drawing Sheets

FIG. 7.
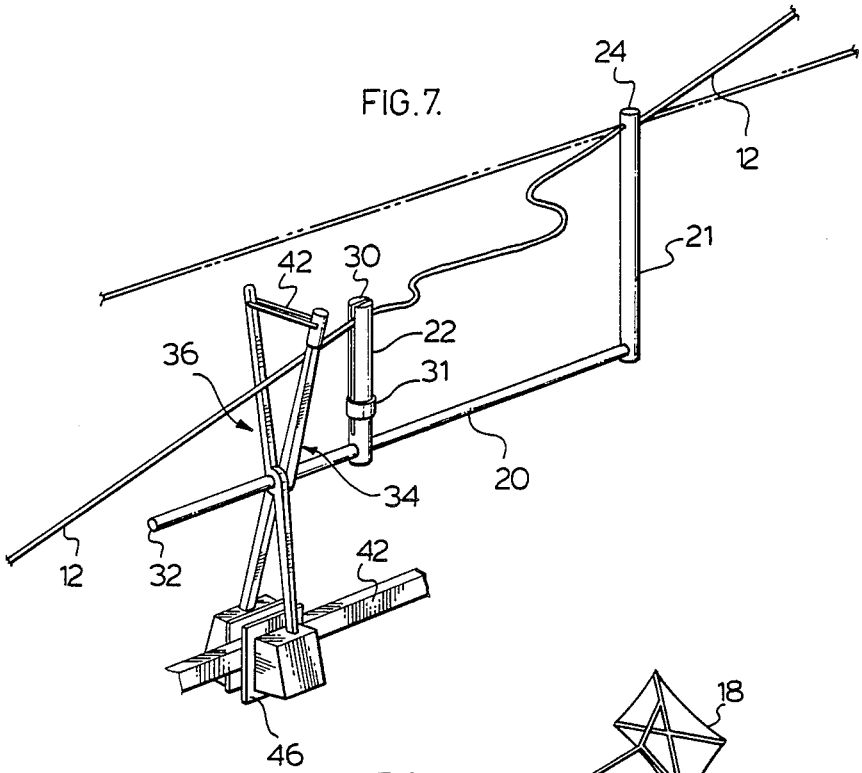
FIG. 8.
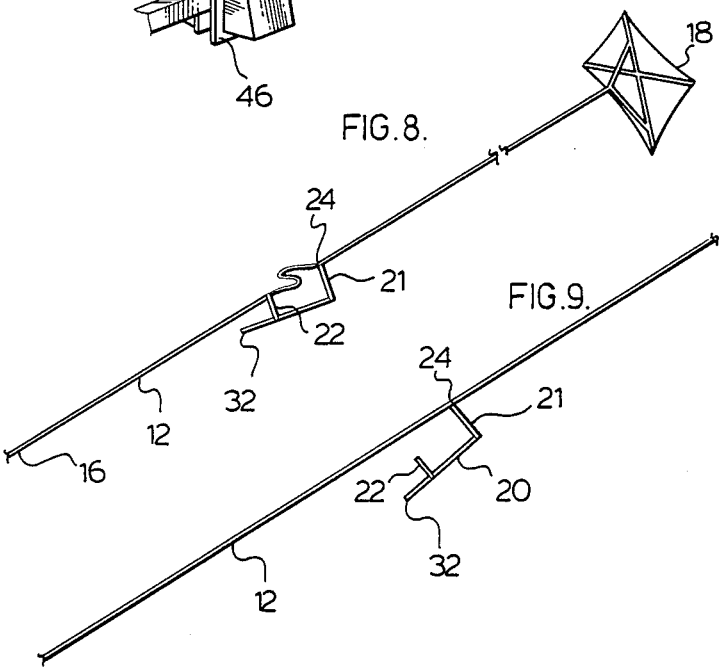
FIG. 9.

KITE LOAD-RELEASING DEVICE

FIELD OF THE INVENTION

This invention relates to devices whereby kites may carry loads upwardly for release and more particularly to a load carrying and releasing pendular device for attachment to a kite string spaced from the kite to hang downwardly from the kite string and release the load on jerking on the kite string.

BACKGROUND OF THE INVENTION

A number of devices are known to permit kites to carry loads aloft and release the same.

Many of these devices utilize toy parachutes which will run up the string of a kite and upon contact with a release device secured to the kite string cause the parachute to become disattached from the kite string and descend. Such device suffer the disadvantage that depending on the nature of the kite utilized, the angulation of the kite string may vary. The nature of the kite needs to be selected having the regard of the parachute device so as to provide a sufficiently low angle to the kite string that the parachute may readily be drawn along the kite string.

Other devices carry the load directly attached to the kite. This has the disadvantage that each time a load may be desired to be carried upward, the kite must be brought all the way to the ground and the load attached to the kite. It is to be appreciated that continual launching of the kite is difficult for a child. Furthermore, the lifting capability and stability of the kite are least when the kite is closest to the ground.

SUMMARY OF THE INVENTION

It is in object of the present invention to at least partially overcome these disadvantages of previous known devices by providing a load carrying and releasing, pendular device for attachment to a kite string spaced from the kite to hang downwardly from the kite and release the load on jerking of the string.

The present invention provides a pendular device for hanging from a kite string fixedly attached to the kite string at a first preferably upper location. The device is also releasably coupled to the kite string at a second preferably lower location. The kite string is releasable from coupling to the device at the second location by jerking on the string of the kite. The device assumes a first raised position when it is coupled to the kite string both at the first upper location and at the second lower location. On jerking the kite string, the string becomes released at the second lower position and the device pivots from the first raised position to a second lower position. This pivoting of the device, providing movement of portions of the device relative to the kite string is utilized to release a load releasably carried by the device.

Present invention also provides a novel clamping means for releasably securing a load to the device.

In one aspect the present invention provides a load carrying and releasing, pendular device for attachment to a kite string spaced from the kite to hang downwardly from the kite string and release the load on jerking of the string, the device comprising:

first coupling means for fixedly coupling the device to the string at a first location on the string, second coupling means for releasably coupling the device to the string at a second location on the string spaced from the first location, the second coupling means releasably engaging the string so as to release the string on jerking of the string, wherein, with the first coupling means coupling the device to the kite string at the first location, the device hangs from the string in a first position when the second coupling means engages the string, and the device pivots about the first location to move from the first position to a second position upon the kite string being released by the second coupling means, load engaging means on the device releasably engaging the load, activation means to cause the load engaging means to release the load, the activation means being activated by relative movement of the kite string and a portion of the device spaced from the first location on pivoting of the device from the first position to the second position.

In another aspect the present invention provides a load carrying and releasing pendular device for attachment to a kite string spaced from the kite to hang downwardly from the kite string and release the load on jerking the string, the device comprising:

elongate support rod means, first coupling means on the support rod means at an upper end of the support rod means extending upwardly from the support rod means to a first end to be fixedly coupled to a kite string, second coupling means on the support rod means spaced from the first coupling means and extending upwardly from the support rod means to a second end carrying an upwardly directed slot to releasably, frictionally engage the kite string and release the kite string on the kite string being jerked, third coupling means on the support rod means between the first and second coupling means spaced from each and extending upwardly away from the support rod means to a third end to be coupled to a kite string, the first, second and third coupling means lying in the same plane with the second end spaced above a straight line drawn between the first and second ends, clamping means on the support rod means lower than the second coupling means to releasably engage a load, the coupling means comprising two clamping arms journaled on the support rod means for pivoting relative to each other with lower ends of the clamp arms movable towards each other to clamp the load therebetween on upper ends of the clamp arms being drawn together, biasing means having one end fixedly coupled to the upper end of one clamp arm and a second end releasable coupled to the upper end of the other clamp arm, the biasing means drawing the upper ends of the clamping arms together, wherein, with the first and third coupling means fixedly coupled to the kite string at positions above the second coupling means, and the second coupling means engaging the string in its slot, the support rod means assumes a first raised portion in which the kite string extends downwardly from the third coupling means to pass between the upper ends of the two coupling arms and underneath the biasing means, whereby on jerking the kite string and releasing the kite string from the slot, the device pivots about the first end downwardly with the kite string contacting the biasing means releasing the second end of the biasing means from the other clamp arm thereby releasing the load.

BRIEF DESCRIPTION OF DRAWINGS

Further aspects and advantages of the invention will appear from the following description taken with the accompanying drawings in which:

FIG. 7 is a pictorial view of a device in accordance with a second embodiment of the invention, and FIGS. 8 and 9 are views similar to views of FIGS. 3 and 4 but showing the second embodiment of FIG. 7.

DETAILED DESCRIPTION OF THE DRAWINGS

Figure 1:
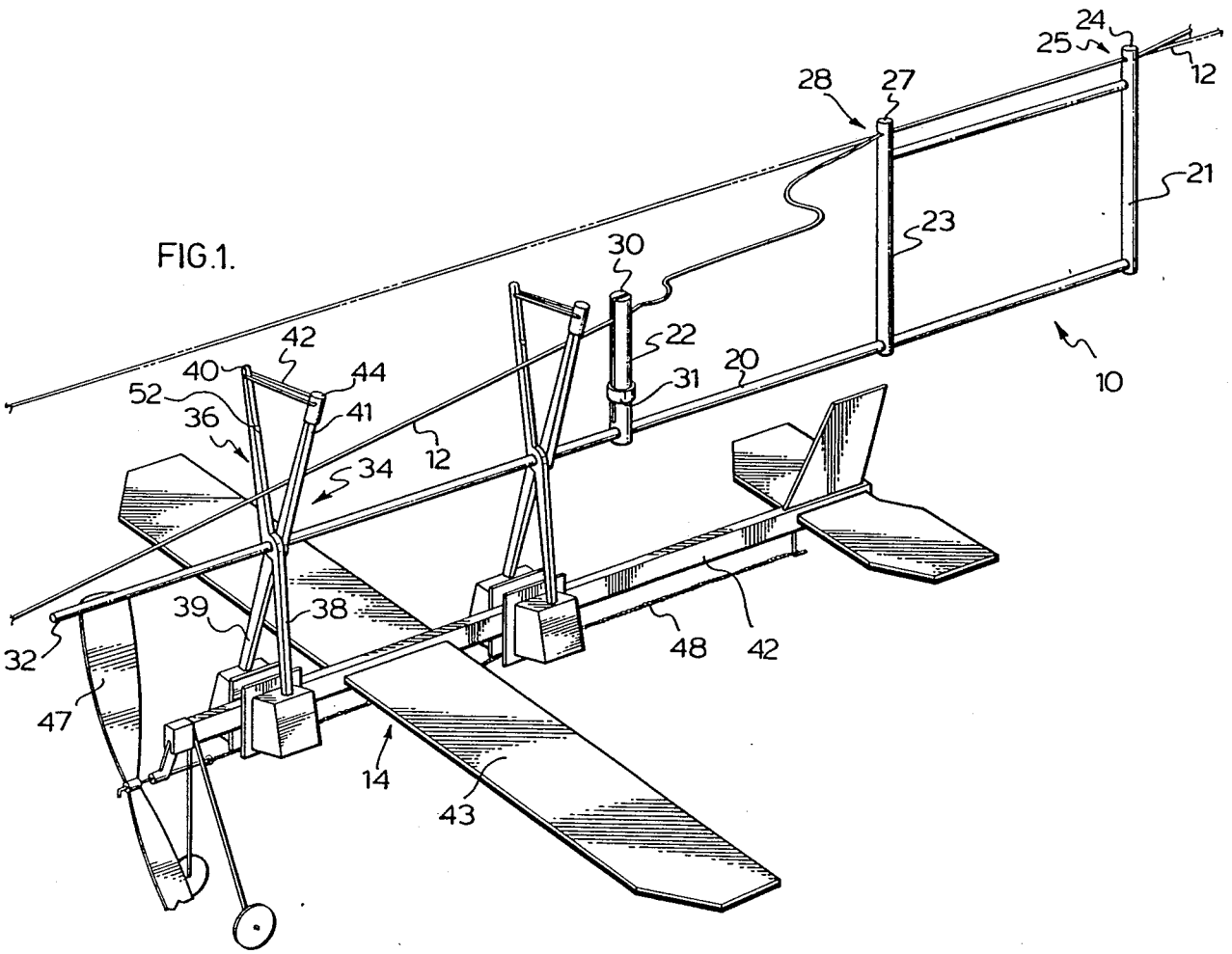
FIG. 1 is a pictorial view of a device in accordance with a first embodiment of the invention coupled to a kite string.

Reference is made first to FIG. 1 in which a load-carrying and releasing device in accordance with a preferred embodiment of this invention, generally indicated as 10 is shown attached to a kite string 12 and carrying a load 14 namely a toy airplane. As seen from FIG. 3, the load carrying device 10 is to be attached to the kite string intermediate a lower end 16 of the kite string to be secured to the ground and the flying kite 18.

The device has elongate dowel-like support rod 20 with three coupling rods 21, 22 and 23 extending upwardly therefrom in the same plane. First coupling rod 21 has its upper end 24 fixedly connected to the kite string as at a first location 25. Third coupling rod 23 has its upper end 27 fixedly coupled to the kite string as at a third location 28. Second coupling rod 22 carries at its upper end an upwardly opening slot 30 to frictionally engage kite string 12. It is to be noted that the upper end of the third coupling rod 23 is spaced upwardly from an imaginary line drawn between the upper ends of the first and second coupling rods 21 and 22.

Slot 30 preferably extends a considerable distance into second coupling rod 22. Advantageously, an elastic band 31 is received tightly about rod 22. Sliding elastic band 31 upwards or downwards on rod 22 serves to increase and decrease the frictional forces which retain string 12 in slot 30.

Figure 3:
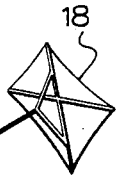
FIG. 3 is a schematic pictorial view of a device similar to that in FIG. 1 in a first position but without the clamping arms or load shown.
Figure 4:
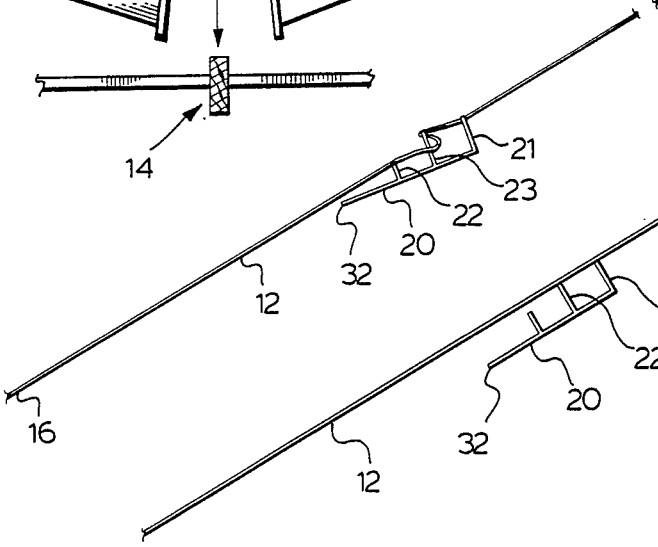
FIG. 4 is a view similar to that of FIG. 3 but in a second position.

FIGS. 3 and 4 show the two different positions the device 10 will assume on the string during flying of the kite. FIG. 3 shows a first position in which the kite string is fixedly coupled to first and third coupling rods 21 and 23 and the kite string is engaged in slot 30 of the second support rod 22. In this position it is to be seen that the ends of first and second coupling rods 21 and 22 are effectively in line with the parabolic curve assumed by the kite string between its lower end 16 and kite 18.

FIG. 4 shows a second position which the device assumes when the string is fixedly coupled to first and third coupling rods 21 and 23 but the string is not engaged in the slot of second coupling rod 22. In this second position, the upper ends of the first and third coupling rods 21 and 23 are effectively in line with the parabolic curve assumed by the kite string.

In use, the device is carried upward by a kite attached on the kite string in the relatively raised, first position as shown in FIG. 3 with the kite string engaged in the slot of second coupling rod 22. Subsequently, the kite string is sufficiently jerked by a user on the ground so that the kite string becomes released from the slot in second coupling rod 22. On the kite string being so released, the device pivots about the upper end 24 of first coupling rod 21 with the device pivoting downward to the relatively lower, second position. As may be seen from a comparison of FIGS. 3 and 4, the lower end 32 of the support rod moves from a relatively closely disposed position near the kite string in the first position of FIG. 3 to a relatively spaced position from the kite string in the second position in FIG. 4. In accordance with the invention, this relative movement of portions of the device spaced from the upper end of the first coupling rod relative to the string is utilized to serve to activate release of the mechanism which grasps the load.

FIG. 1 shows an advantageous form of a clamping device to grasp the load. This clamping device comprises a pair of clamping arms 34 and 36 each having lower ends 38 and 39 to clasp the load therebetween on drawing of upper ends 40 and 41 together. Each clamping arm is shown to be pivotally disposed on the support rod with the support rod 20 passing through openings in the clamping arms. The upper ends of the clamping arms are preferably drawn together by biasing means such as a resilient, elastic member 42 fixedly coupled to the upper end 40 of clamping arm 36 and extending to the upper end 41 the other clamping arm 38 where the elastic member is fixedly coupled to a downward opening hollow cap-like member 44 which slides down onto the upper end 41 of clamping arm 34. Elastic member 42 is chosen so that on the cap-like member being slid down over the other clamping arm, the upper ends of the clamping arms are drawn together. It is to be appreciated that by directing an upward force onto elastic member 42 between the clamping arms, cap-like member 44 can be slid off clamping arm 34 thereby serving to release the load. FIG. 1 shows in a solid line the kite string when the device is in the first position, that is, with kite string 12 engaged in slot 30 of second support rod. With the device in this position, the kite string can be passed through the triangle formed by the upper ends 40 and 41 of the clamping arm and elastic member 42. With the device coupled to the string in this position as shown in FIG. 1, the device may then be permitted to be drawn upward by letting out the string of the kite so the device moves upward as the kite further moves upward. With the device raised above the ground, a user can then jerk on the kite string to release the kite string from slot 30 in the second coupling rod 22. On the kite string being released, the kite string will, in effect, pass from the position shown in solid lines in FIG. 1 (corresponding to that shown in FIG. 3) to the position shown in dotted lines in FIG. 1 (corresponding to the position of the kite string in FIG. 4). This relative movement of the device and kite string will result in the kite string coming into contact with the lower portion of elastic member 42, urging elastic member 42 upward, disengaging cap-like member 44 and thereby releasing the load. In this discussion the kite string has been referred to as moving upward into the elastic member. It is to be appreciated that a more accurate description might be to describe the device as pivoting downward from the first position to the second position about the upper end of the first coupling rod.

Figure 2:
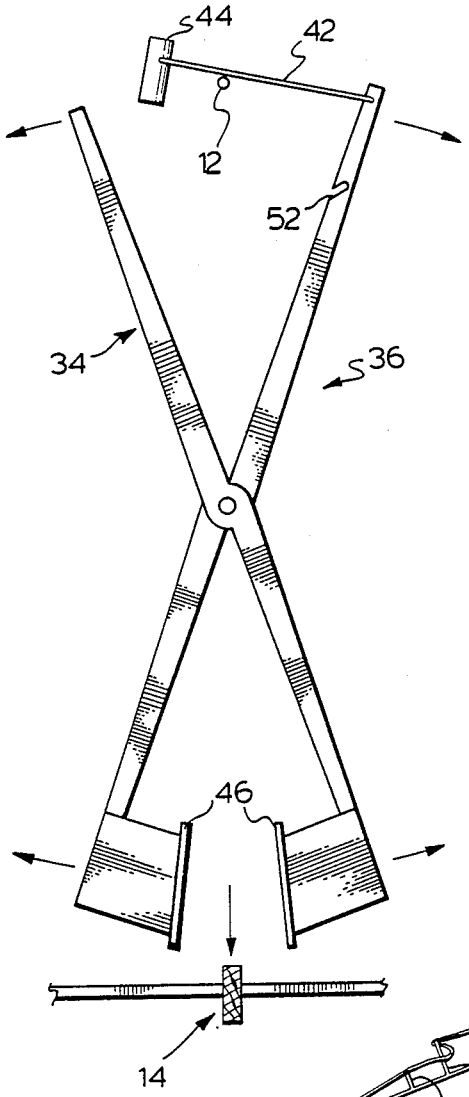
FIG. 2 is a schematic rear view of a pair of clamping arms shown in FIG. 1 on releasing of the load.
Figure 5:
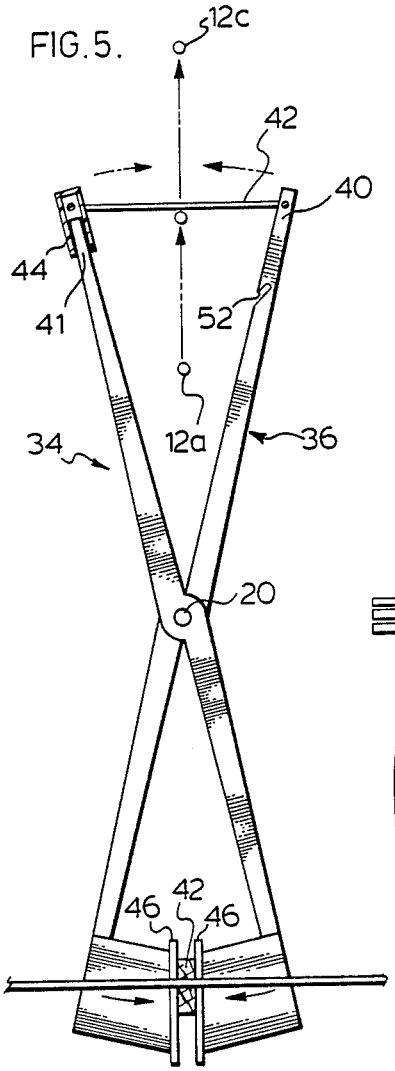
FIG. 5 is a schematic rear view similar to that of FIG. 2 but with the clamping arms engaging the load.

FIG. 5 shows a schematic rear view of one of the pairs of clamping arms with the relative location of the kite string shown as 12*a* when the device is in the first position, and as 12*c* when the device is in the second position. During the release operation the kite string passes to position 12*b* where it will engage elastic member 42 causing cap-like member 44 to be disengaged from the end of clamping arm 34. FIG. 2 shows schematically with arrows relative movement occurring when kite string 12 sufficiently moves the resilient member to disengage cap-like member 44 from the clamping arm, with the clamping arms to swing outwardly away from each other permitting load 14 to drop.

FIG. 1 conveniently shows two pairs of clamping arms, each to engage the narrow fuselage 42 of a known type of airplane model forward and rearward of the wings 43. Clasping the airplane with two clamping arms serves to fixedly hold the airplane against movement. The clamping arms are provided with resilient pads 46 at each of their lower ends to assist in applying frictional clamping forces. The model airplane is shown equipped with a propeller 47 of conventional type which can be driven by a wound elastic band 48 in a known manner. Advantageously the length of the lower ends of the clamping arms can be chosen so that the propeller may not rotate freely but is interfered with by support rod 22. In this manner, the airplane may be clamped onto the device with the elastic band wound and upon release the propeller will draw the airplane forward through the air.

Figure 6:
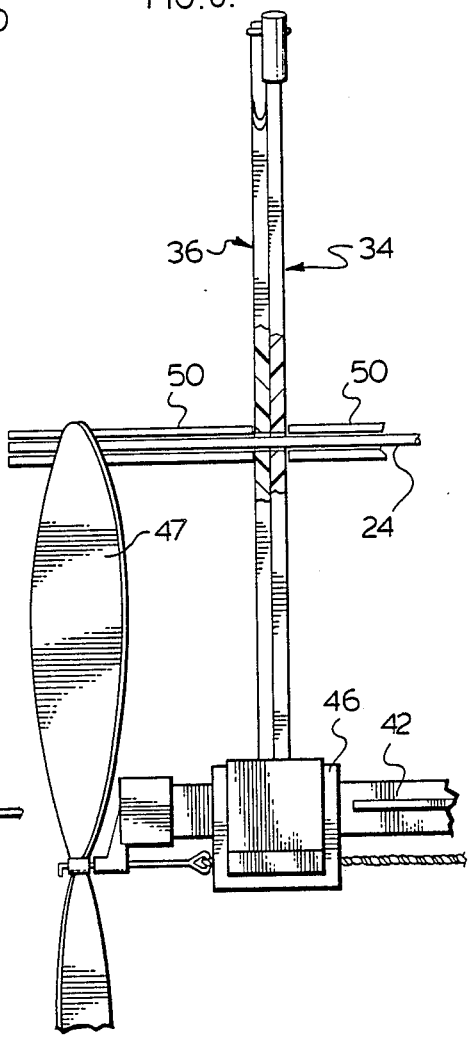
FIG. 6 is an enlarged partially sectioned side view of the front end of an embodiment similar to that shown in FIG. 1.

In accordance with the preferred embodiment of the invention, the support rod can comprise an elongate dowel for example of wood. The first, second and third coupling rods can also comprise wooden dowels journalled on the support rod and preferably fixedly glued in position although the relative rotation of the individual support rods is not necessarily disadvantageous. The clamping arms may be journalled on the support rod preferably with tubular bushings 50 overlaid on support rod 22 as shown only in FIG. 6 so as to locate the clamping arms on the support rod.

FIGS., 1, 2 and 5 show a upwardly directed slot 52 in the upper end of one clamping arm. While not necessary, this slot can be used in initial launching of the device. The kite string may be placed in this slot. On initial release of the device, there can be relatively severe jerking of the kite string. If the kite string is initially placed in this slot 52, this will to some extent assist in preventing the string in becoming released from slot 30 in the second coupling rod. On the kite drawing the device upward, the string typically will come to assume a lower position below the slot as for example shown as 12*a* in FIG. 5.

FIG. 8 schematically shows a device of a second preferred embodiment in accordance with the present invention. Similar reference numbers are used to refer to similar elements in the two embodiments. The second embodiment is substantially identical to the first embodiment with the exception that the third coupling rod 23 has been eliminated. FIGS. 8 and 9 schematically show this second embodiment in a first and a second position, respectively, similar to those shown in FIGS. 3 and 4. The first position is effectively the same as shown in FIG. 3. However in the second position, the device of FIG. 8 is free to hang like a pendulum more directly downwardly from the upper end 24 of the first coupling rod 21. With the second embodiment as shown in FIG. 8 the weight of the device and its load (not shown) together with wind forces acting on the device and the load cause, on release of the kite string from the slot, the device to pivot downwardly about upper end 24 of the first coupling. In accordance with the first embodiment, in addition to the weight of the device and load and the wind loading on the device and load, the tension of the kite string further assists in having the device of FIG. 1 pivot about the upper end of the first coupling rod. The embodiments of FIGS. 1 and 8 each have been chosen so that the weight of the device and load assist in pivoting about the upper end of the first coupling rod. Other embodiments may be chosen so that for example the device may pivot with its forward end to move upwardly.

In the preferred embodiments, the lower end 32 of the device pivots downwardly with the slotted second coupling rod 22 provided downward from the pivot point namely the upper end 24 of the upward located first coupling rod 21. This is not necessary to be in accordance with the present invention. The device could pivot about a pivot point near its lower end with the slotted second coupling rod being provided upward along the kite string from the pivot point.

In accordance with the first embodiment, to permit the tension in the kite string to assist in the pivoting of the device, the upper end of the third coupling rod is located so as to be spaced above a line drawn between the upper ends of the first and second coupling rods. This assist to move the device relative to the kite string can be provided with the upper end of the third coupling rod 23 spaced from a straight line drawn between the upper ends of the first and second coupling rods 21 and 22 as, for example, below this line and/or toward one side thereof.

While the preferred embodiments show the preferred use of scissors-like load clasping and releasing device, many other load clasping and releasing devices could be utilized.

While the invention has been described with reference to embodiments, the invention is not so limited. For a definition of the invention reference is made to the appended claims.

What I claim is:

1. A load carrying and releasing, pendular device for attachment to a kite string spaced from the kite to hang downwardly from the kite string and release the load on jerking of the string, the device comprising:

first coupling means for fixedly coupling the device to the string at a first location on the string, second coupling means for releasably coupling the device to the string at a second location on the string spaced from the first location, the second coupling means releasably engaging the string so as to release the string on jerking of the string, wherein, with the first coupling means coupling the device to the kite string at the first location, the device hangs from the string in a first position when the second coupling means engages the string, and the device pivots about the first location to move from the first position to a second position upon the kite string being released by the second coupling means, load engaging means on the device releasably engaging the load, activation means to cause the load engaging means to release the load, the activation means being activated by relative movement of the kite string and a portion of the device spaced from the first location on pivoting of the device from the first position to the second position.

2. A device as claimed as in claim 1, wherein on the string being released by the second coupling means, the device pivots about the first location under the weight of the device and load.

3. A device as claimed as in claim 1, wherein on the string being released by the second coupling means the device pivots about the first location under the weight of the device and load and under forces of the wind acting on the device and load.

4. A device as claimed as in claim 1, further including third coupling means fixedly coupling the device to the string at a third location between the first and second locations, spaced from each and spaced from a straight line drawn between the first and second locations.

5. A device as claimed in claim 4 wherein on the string being released by the second coupling means, the device pivots about the first location as a result of tension in the kite string forcing the second and third locations to lie on a parabolic curve assumed by the kite string.

6. A device as claimed in claim 1 wherein said second coupling means comprises a slot to frictionally engage the string therein, the frictional forces permitting release of string from the slot on jerking of the kite string.

7. A device as claimed in claim 1 wherein said load engaging means comprises a clamping device biased to clamp on to the load.

8. A device as claimed in claim 1 wherein said clamping device comprises two clamping arms pivotable relative to each other for urging one clamping end of each together to clasp the load therebetween by drawing of opposite ends of the clamping arms together, the device including biasing means to draw the opposite ends of the clamping arms together, wherein in the first position the string passes between the two opposite ends of the arms and under the biasing means, and whereby on pivoting of the device from the first position to the second position upon the string being released from the second coupling means, the string will contact the biasing means to disengage it from drawing the opposite ends of the clamping arms together, thereby releasing the load.

9. A load carrying and releasing, pendular device for attachment to a kite string spaced from the kite to hang downwardly from the kite string and release the load on jerking of the string, the device comprising:

first coupling means for fixedly coupling the device to the string at a first upper location on the string, second coupling means for releasably coupling the device to the string to a second location on the string below the first location, the second coupling means releasably engaging the string so as to release the string on jerking of the string, wherein, with the first coupling means coupling the device to the kite string at the first location, the device hangs from the string in a first raised position when the second coupling means engages the string, and the device pivots downwardly about the first location to move from the first raised position to a second lower position upon the string being released by the second coupling means, load engaging means on the device releasably engaging the load to hang downwardly from the device, activation means to cause the load engaging means to release the load, on release of the kite string by the second coupling means, by relative movement of the kite string and lower portions of the device spaced from the first location.

10. A load carrying and releasing, pendular device for attachment to a kite string spaced from the kite to hang downwardly from the kite string and release the load on jerking the string, the device comprising:

elongate support rod means, first coupling means on the support rod means at an upper end of the support rod means extending upwardly from the support rod means to a first end to be fixedly coupled to a kite string, second coupling means on the support rod means spaced from the first coupling means and extending upwardly from the support rod means to a second end carrying an upwardly directed slot to releasably, frictionally engage the kite string and release the kite string on the kite string being jerked, third coupling means on the support rod means between the first and second coupling means spaced from each and extending upwardly away from the support rod means to a third end to be coupled to a kite string, the first, second and third coupling means lying in the same plane with the second end spaced above a straight line drawn between the first and second ends, clamping means on the support rod means lower than the second coupling means to releasably engage a load, the coupling means comprising two clamping arms journaled on the support rod means for pivoting relative to each other with lower ends of the clamp arms movable towards each other to clamp the load therebetween on upper ends of the clamp arms being drawn together, biasing means having one end fixedly coupled to the upper end of one clamp arm and a second end releasable coupled to the upper end of the other clamp arm, the biasing means drawing the upper ends of the coupling arms together, wherein, with the first and third coupling means fixedly coupled to the kite string at positions above the second coupling means, and the second coupling means engaging the string in its slot, the support rod means assumes a first raised portion in which the kite string extends downwardly from the third coupling means to pass between the upper ends of the two coupling arms and underneath the biasing means, whereby on jerking the kite string and releasing the kite string from the slot, the device pivots about the first end downwardly with the kite string contacting the biasing means releasing the second end of the biasing means from the other clamp arm thereby releasing the load.

* * * * *